US011111101B2

(12) United States Patent
Lindbuechl et al.

(10) Patent No.: US 11,111,101 B2
(45) Date of Patent: Sep. 7, 2021

(54) UNREELING APPARATUS AND METHOD

(71) Applicant: SMS group GmbH Sitz Duesseldorf, Duesseldorf (DE)

(72) Inventors: Joerg Lindbuechl, Moenchengladbach (DE); Thomas Cmiel, Moenchengladbach (DE); Dirk Hessberger, Moenchengladbach (DE); Heinz-Willi Greuel, Moenchengladbach (DE)

(73) Assignee: SMS GROUP GMBH SITZ DUESSELDORF, Duesseldorf (DE)

( * ) Notice: Subject to any disclaimer, the term of this patent is extended or adjusted under 35 U.S.C. 154(b) by 206 days.

(21) Appl. No.: 16/273,465

(22) Filed: Mar. 29, 2019

(65) Prior Publication Data

US 2020/0307948 A1 Oct. 1, 2020

(51) Int. Cl.

| | |
|---|---|
| ***B65H 63/04*** | (2006.01) |
| ***B21C 47/18*** | (2006.01) |
| ***B65H 49/28*** | (2006.01) |
| ***B21C 47/24*** | (2006.01) |

(52) U.S. Cl.

CPC ..... *B65H 63/04* (2013.01); *B21C 47/18* (2013.01); *B21C 47/245* (2013.01); *B65H 49/28* (2013.01); *B65H 2701/30* (2013.01); *B65H 2701/36* (2013.01)

(58) Field of Classification Search

CPC ..... B65H 49/28; B65H 49/324; B65H 63/04; B65H 67/02; B65H 2701/36; B21C 47/20; B21C 47/24

See application file for complete search history.

(56) References Cited

U.S. PATENT DOCUMENTS

| | | | |
|---|---|---|---|
| 2,349,873 | A | 5/1944 | Lisy |
| 2,437,630 | A | 3/1948 | Williams et al. |
| 2,575,785 | A | 11/1951 | Beaman et al. |
| 3,137,452 | A | 6/1964 | Winders |

(Continued)

FOREIGN PATENT DOCUMENTS

| | | |
|---|---|---|
| DE | 19 54 675 A1 | 5/1971 |
| DE | 87 04 357 U1 | 7/1987 |
| DE | 94 07 477 U1 | 7/1994 |

(Continued)

OTHER PUBLICATIONS

European Search Report in EP 19156623.1-1016 dated Jan. 23, 2020 with English translation of relevant parts.

*Primary Examiner* — William E Dondero
(74) *Attorney, Agent, or Firm* — Collard & Roe, P.C.

(57) ABSTRACT

In order to increase the operational safety of an unreeling apparatus and an unreeling method at high working speed, an unreeling apparatus for unreeling a ring of wire along a pull-off direction, having at least two reel crowns, which can each be brought into a pull-off position and into a preparation position and/or loading position by way of a displacement device, includes a safety apparatus having an overload safety device and having a safety guide track, which has a directional component that faces in the pull-off direction and acts independently of the other reel crown, at least for the reel crown situated in the pull-off position, wherein the overload safety device holds the reel crown situated in the pull-off position in the pull-off position and, in the event of an overload, releases the reel crown situated in the pull-off position into the safety guide track.

20 Claims, 7 Drawing Sheets

(56) References Cited

U.S. PATENT DOCUMENTS

| | | | |
|---|---|---|---|
| 4,355,526 | A | 10/1982 | Miles |
| 5,097,688 | A | 3/1992 | Taylor et al. |

FOREIGN PATENT DOCUMENTS

| | | | |
|---|---|---|---|
| DE | 10 2018 121 286 | A1 | 3/2019 |
| EP | 0 446 687 | A1 | 9/1991 |
| EP | 2 374 746 | A1 | 10/2011 |
| FR | 2 661 118 | A1 | 10/1991 |

UNREELING APPARATUS AND METHOD

BACKGROUND OF THE INVENTION

1. Field of the Invention

The invention relates to an unreeling apparatus and to an unreeling method.

2. Description of the Related Art

It is known, for example from DE 87 04 357 U1, to unreel wires, in particular metallic wires, from reels, also called rings or coils, in that a pull is exerted on the wire. In this regard, it is apparent that the unreeling apparatuses and methods presented in this document can be suitable only for very small and easily bendable wires, since the design implementation is relatively delicate.

SUMMARY OF THE INVENTION

It is the task of the present invention to increase operational safety in an unreeling apparatus and an unreeling method at high working speed.

The task of the invention is accomplished by means of unreeling apparatuses and unreeling methods having the characteristics of the independent claims. Further advantageous embodiments, if applicable also independent of these, are found in the dependent claims and in the following description.

In this regard, the invention proceeds from the basic idea that although a multiple reel, in particular a double reel is advantageous for reasons of working speed, the reel crown from which unreeling takes place should be mounted in as stable a manner as possible and separately.

Thus, an unreeling apparatus for unreeling a ring of wire along a pull-off direction, having at least two reel crowns, which can each be brought into a pull-off position and into a preparation position and/or loading position by way of a displacement device, can be characterized in that the unreeling apparatus comprises a safety apparatus having an overload safety device and a safety guide track, which track has a directional component that faces in the pull-off direction and acts independently of the other reel crown, at least for the reel crown situated in the pull-off position, wherein the overload safety device holds the reel crown situated in the pull-off position in the pull-off position and, in the event of an overload, releases the reel crown situated in the pull-off position into the safety guide track, so as to increase the operational safety at high working speed in an unreeling apparatus and an unreeling method.

When unreeling a ring from an unreeling apparatus, it can happen, due to various circumstances, for example due to knotting of the wire, that the wire can no longer be unreeled and the unreeling apparatus therefore comes to a stop. However, the wire continues to be pulled in by a subsequent machine, so that a very great force acts on the unreeling apparatus, which has suddenly come to a stop. In this regard, sometimes the entire unreeling apparatus can be torn out of its foundation by the high forces that suddenly occur. It is understood that this risk exists, in particular, in the case of thicker wires and correspondingly great machine stresses.

Therefore, in order to increase the operational safety of an unreeling apparatus, a corresponding safety apparatus having an overload safety device is used, so that in the case of a problem, for example caused by a knot in the wire, the unreeling apparatus is brought to a stop, so that possible damage as well as risk of injury and damage to the machine can be reduced, in particular prevented. However, since, for one thing, the unreeling apparatus, when it is stopped, cannot come to a complete stop immediately, and, for another thing, when the unreeling apparatus is stopped, very great forces act on it, the unreeling apparatus could be torn out of its foundation even if it were stopped in timely manner or immediately, and could cause significant damage. The claimed safety guide track served to provide a safety path to the unreeling device when stopped, along which it can move, so that during displacement along this safety guide track, sufficient time can be gained so that residual forces that occur during a stop can be absorbed, and the unreeling apparatus can still move in the direction of the acting forces, so as to keep the forces that act on the unreeling apparatus as low as possible until the corresponding reel crown comes to a stop.

It is advantageous if the safety guide track has a safety guide axis. Such a safety guide axis can be implemented easily in terms of design, so that corresponding guidance can be made possible in the simplest manner possible. Furthermore, such a safety guide axis can be configured to be very stable, so that guidance of the reel crown can take place in operationally safe manner.

It is advantageous if the overload safety device comprises a press-down device that presses a reel crown holder against a pull-off position stop in the pull-off position. By means of this press-down device, the result can be achieved, in the simplest possible manner and in operationally safe manner, that the reel crown holder, in the pull-off position, is pressed against a pull-off position stop, and the result is achieved that in normal operation of the unreeling apparatus, the latter is positioned, during unreeling, in such a manner that in the event of an overload, the entire path of the safety guide track is available. Otherwise, the unreeling apparatus could already have been or be displaced to the stop of the safety guide track in the direction of the unreeling force that is in effect, purely as the result of the force that acts on the unreeling apparatus in the course of unreeling.

It is advantageous if the press-down device is configured hydraulically or pneumatically. This allows relatively simple and operationally safe control. In particular, the hydraulics or the pneumatics can have a pressure relief valve, which opens in the event of overload. Hydraulically or pneumatically configured press-down devices can be implemented in the simplest possible manner, so as to be able to apply the required force. Understandably, it is also possible to configure the press-down device in a different way, for example electrically. It is advantageous if a pressure relief valve is also provided for the press-down device, so that the latter can open in the event of an overload, so that possible damage in the case of an overload can be prevented. In particular, the pressure relief valve can be used as an overload safety device; this is easy to implement structurally.

Furthermore, the safety apparatus can comprise a safety sensor, which detects if the reel crown holder leaves the pull-off position stop, and which is connected to act together with the pulling device that acts on the wire being unreeled, in such a manner that this device stops when the reel crown holder leaves the pull-off position stop. By means of this safety sensor, the result can be achieved that no further wire or as little further wire as possible is unreeled by the unreeling apparatus if the reel crown holder leaves the pull-off position stop. In this way, process safety is increased in the simplest possible manner, in terms of design, because in the case of such an event, possible hazards are further prevented in that no additional wire is unreeled.

An unreeling apparatus for unreeling a ring of wire along a pull-off direction, having at least two reel crowns, each of which can be brought into a pull-off position and a preparation position and/or loading position by way of a displacement device, can also be characterized in that the displacement device has an aboveground drive and/or an aboveground guide or aboveground mounting, so as to increase operational safety in an unreeling apparatus and an unreeling method at high working speed. By means of implementation as an aboveground drive or aboveground guide or aboveground mounting, the operational safety of the unreeling apparatus can be further increased, since the elements are disposed above ground, in each instance, and represent the lowest possible risk of danger for the immediate vicinity. Furthermore, possible maintenance work can be significantly simplified, since these elements are more easily accessible.

Preferably, the displacement device comprises a displaceable rotary body for holding at least one of the two reel crowns. Such a displaceable rotary body can form a rotary displacement device, in rotational manner, with the simplest possible implementation, in terms of design, and, at the same time, guaranteed great stability.

It is advantageous if the rotary body is driven by way of the aboveground drive and/or guided by way of the aboveground guide and/or mounted by means of the aboveground mounting. Such an arrangement allows the simplest possible implementation, in terms of design, with simultaneous great stability, since multiple separate mountings or guides are not required, but rather the rotary body can stand in direct connection with the drive or with the guide or with the mounting.

In order to also achieve simple implementation, in terms of design, with great stability, it is advantageous to structure the rotary body so as to be displaceable solely in one plane, preferably solely horizontally.

Furthermore, the rotary body can have a rotation axis, and the safety guide axis can be disposed not identically with, preferably truly parallel with the rotation axis. By means of the preferably truly parallel placement of the safety guide axis to the rotation axis, great stability can be achieved with the simplest possible configuration, in terms of design, wherein the separation of the two axes is implemented with a simple design, in particular in contrast with axes that lie one on top of the other.

Alternatively, the rotary body has a rotation axis, and the safety guide axis corresponds to the rotation axis. Such an arrangement has the advantage that the smallest possible number of components is used; this sometimes increases the operational reliability of the rotary body, but then coordination tasks occur, in terms of design, so as to separate the movements in the event of overload from the movements that occur during normal operation, as such.

The design of the unreeling apparatus can furthermore be simplified further if the two reel crowns are mounted on the rotary body. Above all, the two reel crowns can then be displaced using a joint drive, if this drive is suitably connected with the rotary body, so that a change-over of the reels between different positions, such as, for example, a pull-off position, a preparation position or a loading position, can take place in rapid and operationally reliably synchronized manner.

Furthermore, an unreeling apparatus for unreeling a ring of wire along a pull-off direction, having at least two reel crowns, which can each be brought into a pull-off position and into a preparation position and/or loading position, by way of a displacement device, can be characterized in that a rotary body is provided per reel crown, so as to increase the operational safety in an unreeling apparatus and an unreeling method at high working speed. The fact that a rotary body is provided for each reel crown makes it possible for both reel crowns to rotate or position themselves, in particular independently of one another. Thus, during unreeling of the one reel crown, the other reel crown can be brought into position for loading. In this way, dead times, which would occur when new wire is made available, are minimized. In this regard, if necessary, the disadvantage of a somewhat more complex drive can be accepted in return for this advantage.

It can be advantageous if the rotary bodies have an identical rotation axis; as a result, fewer components are required, in total, and this also reduces the costs of the apparatus, for example, and furthermore increases the operational safety of the apparatus.

Also, an unreeling apparatus for unreeling a ring of wire along a pull-off direction, having at least two reel crowns, which can each be brought into a pull-off position and into a preparation position and/or loading position by way of a displacement device, can be characterized in that the displacement device comprises a displaceable rotary body that carries a tilting device for holding at least one of the two reel crowns, and that the reel crown can be tilted between the preparation position and the loading position by the tilting device, so as to increase the operational safety in an unreeling apparatus and an unreeling method at high working speed.

By means of this embodiment, it is possible to set the reel crowns in accordance with the work steps assigned to them, by means of the simplest possible design. While the one reel crown stands vertically, for example, and is unreeled, the other reel crown can be tilted into the preparation position, and during unreeling of the first reel crown, the second reel crown can be prepared or loaded. Therefore the most efficient loading and/or unreeling process is possible, since setup times or dead times are minimized or actually completely eliminated.

Preferably, the tilting device comprises a lever, on the one arm of which the reel crown is disposed and on the other arm of which a tilt joint is disposed. This embodiment can be implemented particularly easily, in terms of design, and is extremely stable at the same time. The latter particularly holds true if the lever is held on the rotary body by way of the tilt joint.

It is also advantageous for simple implementation, in terms of design, if the arm on which the reel crown is disposed is connected with the other arm by way of an overload joint. In this way, if necessary, the overload safety device explained initially can be made available in structurally simple manner, wherein the overload case can then also be detected in relatively simple manner, in terms of measurement technology, namely precisely when the overload joint responds to an overload.

It is advantageous if the tilting device has a tilt axis that lies at the height of the reel crown and preferably intersects the latter. This has the advantage that moments that must be applied by the tilting device can be reduced, and this holds true to a particular degree if the tilt axis intersects the reel crown.

An unreeling apparatus for unreeling a ring of wire along a pull-off direction, having at least two reel crowns, which can each be brought into a pull-off position and into a preparation position and/or loading position by way of a displacement device, can also be characterized in that in the pull-off position, a deflection wall is provided, at least in the region of the pulled-off wire and/or at least in the region of the reel crown situated in the pull-off position or its reel mandrel relative to the reel crown not situated in the pull-off position, so as to increase the operational safety in an unreeling apparatus and an unreeling method at high working speed. The deflection wall ensures that unreeling is carried out in operationally safe manner, because the two reel crowns are shielded from one another or protected against one another.

It is advantageous if the deflection wall is disposed on the rotary body, because such placement can be implemented in particularly simple manner, in terms of design, and the deflection wall can be attached in sufficiently stable manner.

Likewise, an unreeling method for a ring of wire, in which the wire is pulled off from a reel crown by a pull that acts on the wire in a pull-off direction, can be characterized in that in the event of an overload, the reel crown is released in the pull-off direction and the pull is stopped, so as to increase the operational safety in an unreeling apparatus and an unreeling method at high working speeds. By means of the release in the pull-off direction, it can be prevented that an overload tears the entire reel crown out of its attachment, in particular if a pull continues to act on the reel crown. At the same time, the pull is terminated, so that the forces that still act on the reel crown can be restricted to a minimum.

It is advantageous if the reel crown is released, in guided manner, with a directional component that faces in the pull-off direction, so that release of the reel crown can be carried out in the safest possible manner, in terms of process.

Furthermore, the unreeling apparatus can also be configured as a double reel. Such a double reel allows the simplest possible implementation, in terms of design, of the unreeling apparatus.

It is understood that the characteristics of the solutions described above and in the claims can also be combined, if applicable, so as to be able to implement the advantages cumulatively, accordingly.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
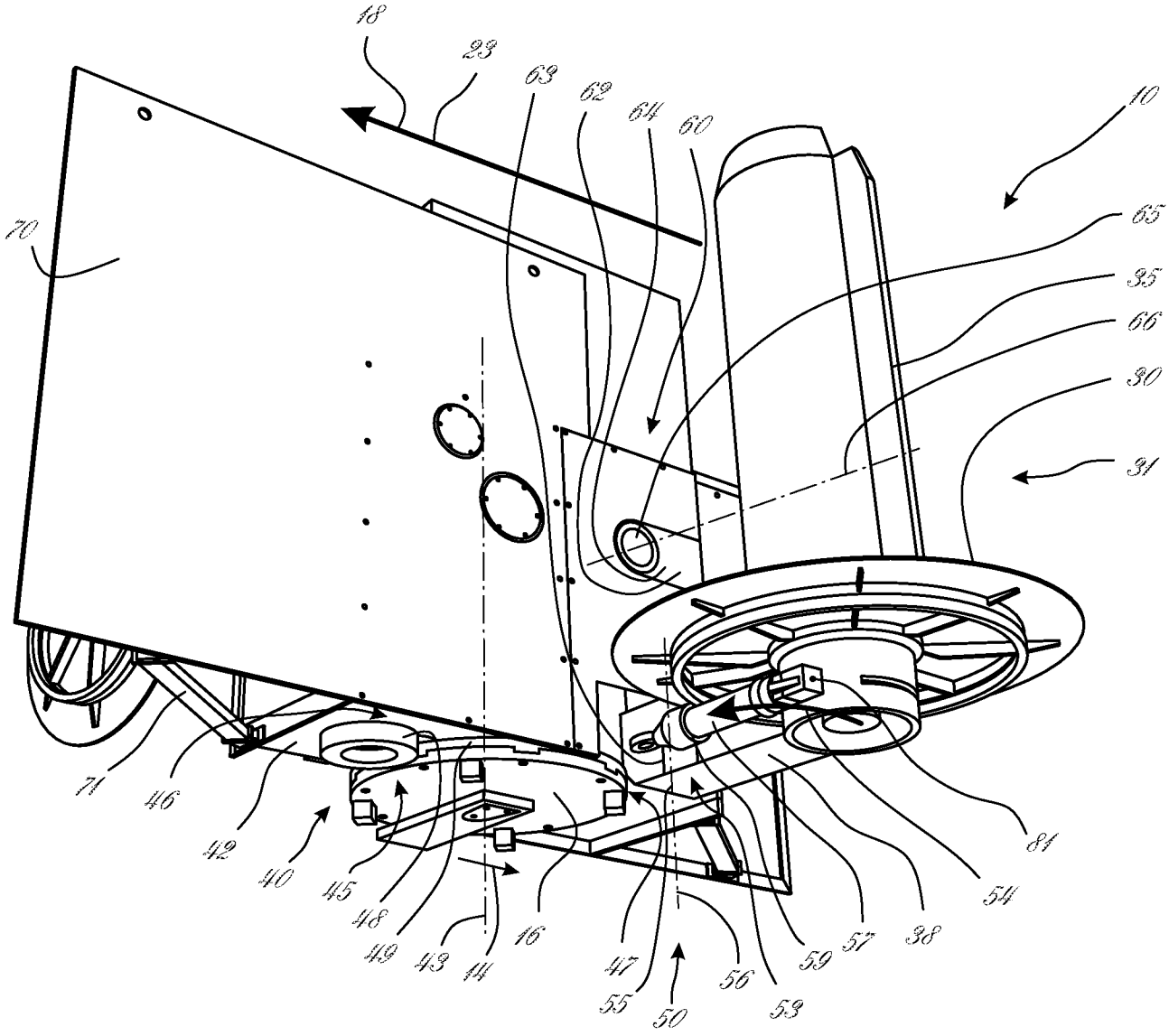
FIG. 1 an unreeling apparatus in a perspective view, at a slant from below.
Figure 2:
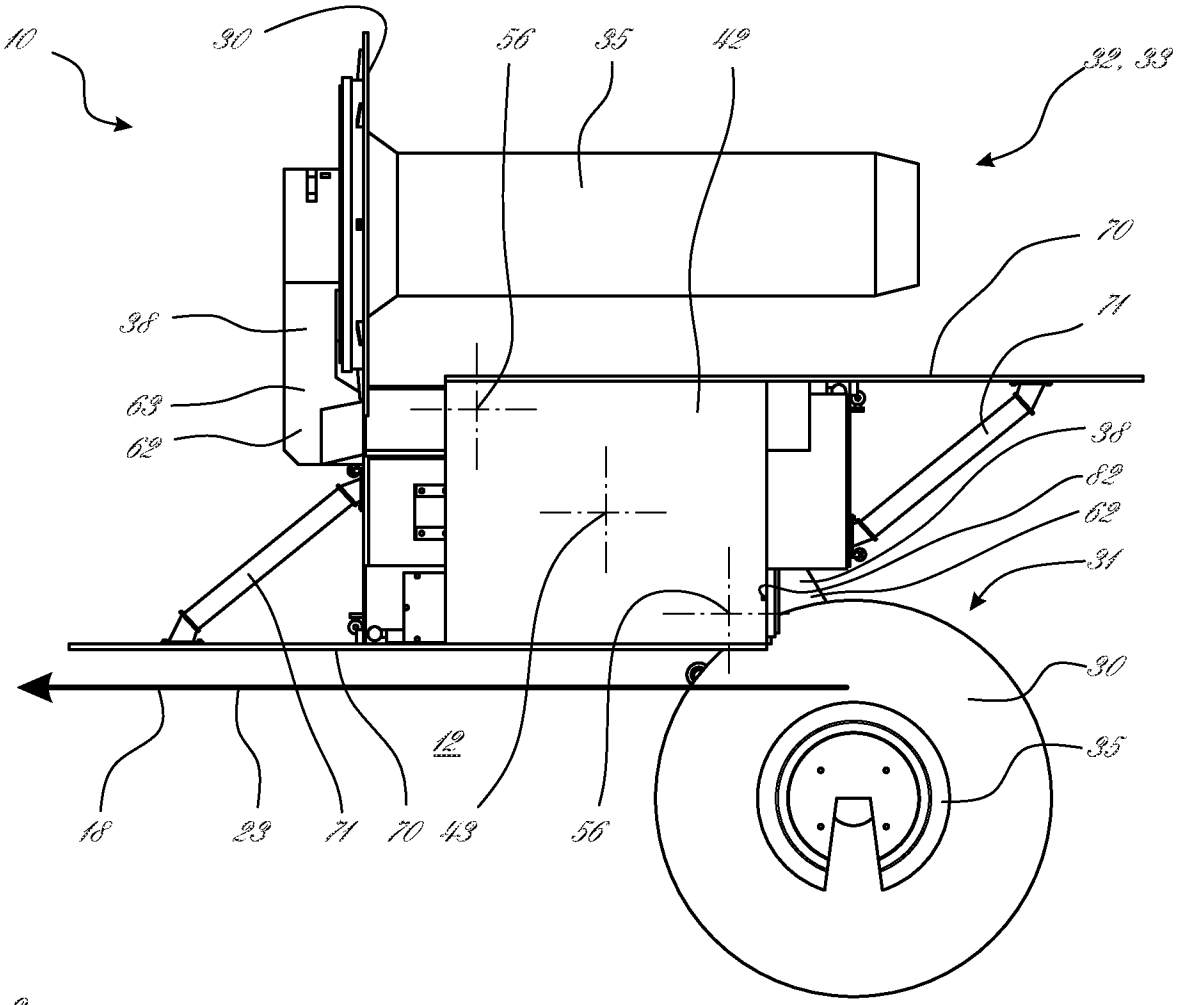
FIG. 2 the unreeling apparatus according to FIG. 1 in a side view.

FIGS. 1 and 2 show an unreeling apparatus 10, in which two reel mandrels 35 are each disposed on a mandrel crown 30, wherein one of the two reel mandrels 35 is situated in the pull-off position 31 and the second of the two reel mandrels 35 is situated in the preparation position or loading position 32, 33, wherein the second of the two reel mandrels 35 cannot be seen in the representation according to FIG. 1.

The unreeling apparatus 10 can allow a wire 22 to be pulled off in the pull-off direction 23, in known manner, when the wire 22, which is situated on the reel crown 30 as a ring 20, is put under stress from a pull 18. The wire 22 and the ring 20 are not shown in FIGS. 1 to 3, but they are represented schematically in FIGS. 4 to 7.

The unreeling apparatus 10 comprises a rotary body 42, which is mounted on the floor 12 so as to be displaceable about a rotation axis 43.

A displacement device 40 serves for displacing the reel mandrels 35 between a pull-off position 31 and preparation position 32 or loading position 33, in each instance. The displacement device 40 comprises an aboveground drive 45, which is formed from an aboveground pinion 48 and a fixed gear wheel 49, as well as an aboveground guide 46 along which the rotary body 42 is rotated about a rotation axis 43 during displacement by way of an aboveground mounting 47. The displacement device 40 is connected with the floor 12 by means of a floor fitting 16.

A horizontal 14 direction, correspondingly parallel to the floor, can also be defined by the floor 12.

Figure 3:
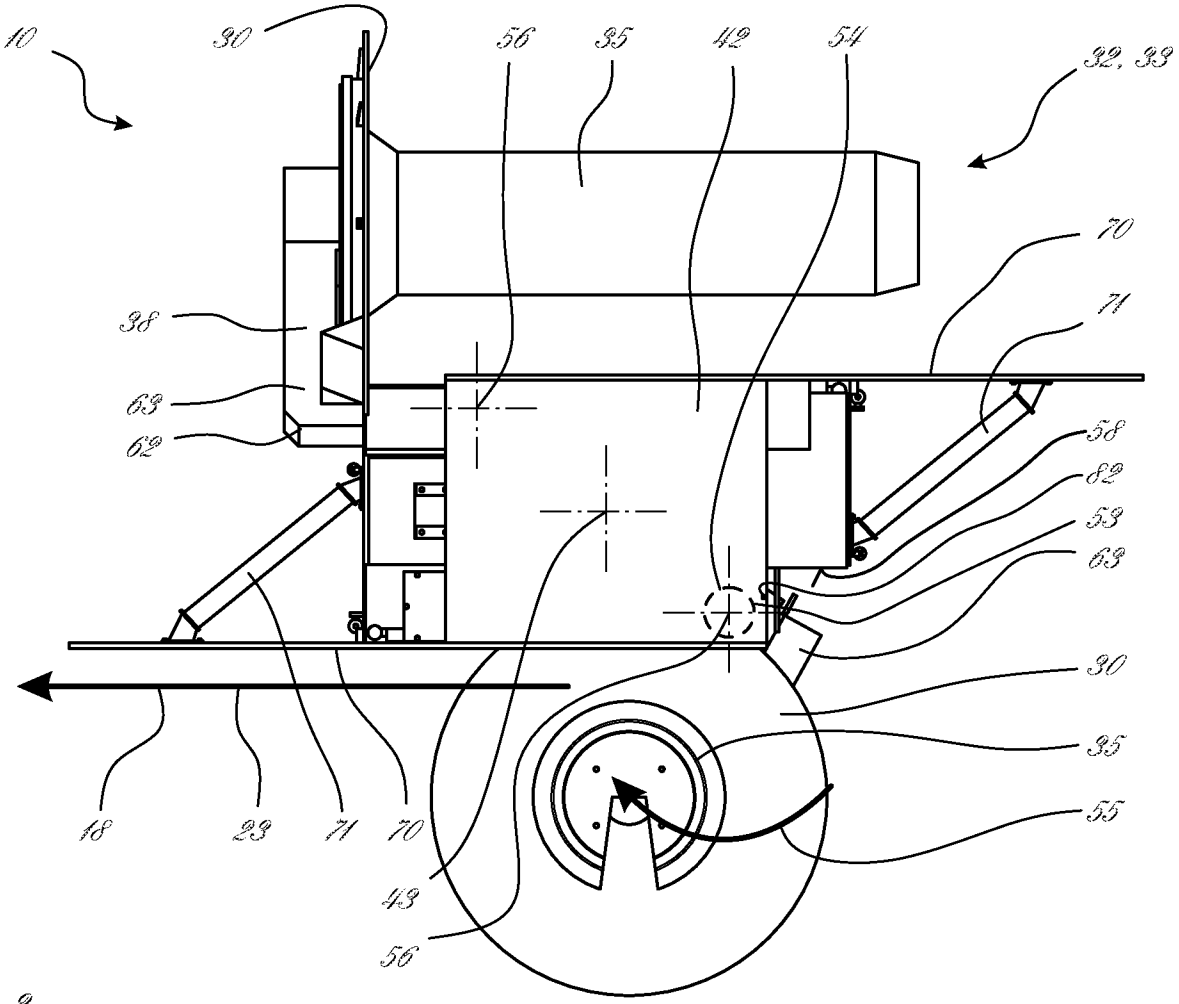
FIG. 3 the unreeling apparatus according to FIGS. 1 and 2 in a side view, with a reel crown disposed along a safety guide track configured as a safety guide axis.

Furthermore, the unreeling apparatus 10 comprises a safety apparatus 50 including a safety sensor 82 shown in FIGS. 2 and 3. This apparatus is supposed to guarantee operationally safe procedures in the event of an overload. In the event of an overload, a reel crown holder 38, which grasps the reel crown 30, is displaced along the pull-off direction 23 in the direction of the pull 18, by way of an overload joint 53 that serves as an overload safety device 52, wherein this displacement is guided by a safety guide track 54 and takes place about a safety guide axis 56.

In the case of a normal state, when no overload is present, the reel mandrel 35 is held in its pull-off position 31 by means of a press-down device 57, which comprises hydraulic cylinders 59 that press or hold the reel mandrel 35 against a pull-off position stop 58, see FIG. 3, in accordance with its position, so that forces that have occurred due to the pull-off process do not already result in a movement of the reel mandrel 35 along the safety guide track 54. As shown in FIG. 1, press-down device 57 has a pressure relief valve 81 which opens in the event of overload.

Furthermore, the unreeling apparatus 10 comprises a tilting device 60, which comprises a lever 62, arms 63, 64, as well as a tilt joint 65 and a tilt axis 66. The reel mandrels 35 can be tilted by means of this tilting device 60, so as to tilt the one reel mandrel 35 into a horizontal position in the preparation position or loading position 32, 33 and to set it upright again, correspondingly.

Furthermore, two deflection walls 70 are disposed between the two reel mandrels 35 by means of deflection wall holders 71. The deflection walls 70 guarantee operationally safe sequences, in particular with regard to the second reel mandrel 35, if an overload occurs on the first reel mandrel 35. For example, the deflection wall 70 prevents the wire 22 from getting into the direct working region of the second reel mandrel 35 if it kicks out. As a result, both loading and preparation can take place independently of pull-off and in operationally safe manner.

FIGS. 2 and 3 show the exemplary embodiment according to FIG. 1 in a side view, wherein the reel mandrel 35, which is situated in the pull-off position 31 in FIG. 2, is in the normal state, and the wire 22 is pulled off along the pull-off direction 23 by way of a pull 18. In FIG. 3, in contrast, the corresponding reel mandrel 35 is in the overloaded state, wherein the mandrel has been displaced along the directional component 55 and along the safety guide track 54 by means of an overload joint 53, about the safety guide axis 56. In this regard, in this exemplary embodiment the safety guide track 54 is oriented in a circle around the safety guide axis 56. In deviating embodiments, however, a straight-line safety guide track is also conceivable, in that a carriage that can be displaced along a corresponding linear guide is provided, for example. It is understood that the safety guide track can also be configured to be more complex, for example elliptical, depending on the concrete requirements.

In FIGS. 2 and 3, it can be seen that in this exemplary embodiment, the reel mandrel 35, when in the pull-off position 31, is situated in a position that is not completely shielded with regard to the reel mandrel 35 in the loading position or preparation position 32, 33 by the deflection wall 70, which is disposed on the pull-off position side, so that in this exemplary embodiment, the second deflection wall 70 on the loading position side is supplementally provided, so as to also completely protect the second reel mandrel in its loading position 33 and the space in its vicinity with regard to the first reel mandrel 35 in the pull-off position 31.

However, it is also conceivable to structure one of the two deflection walls 70 in displaceable manner, so as to correspondingly move the deflection walls 70 during displacement of the reel mandrels 35, so that the reel mandrels 35 can be displaced in collision-free and operationally safe manner. However, repositioning of the deflection walls 70 might not be necessary if these two deflection walls suitably supplement one another to form a common deflection wall or if it is possible to position a deflection wall with sufficient protection, in correspondingly continuous manner.

Figure 4:
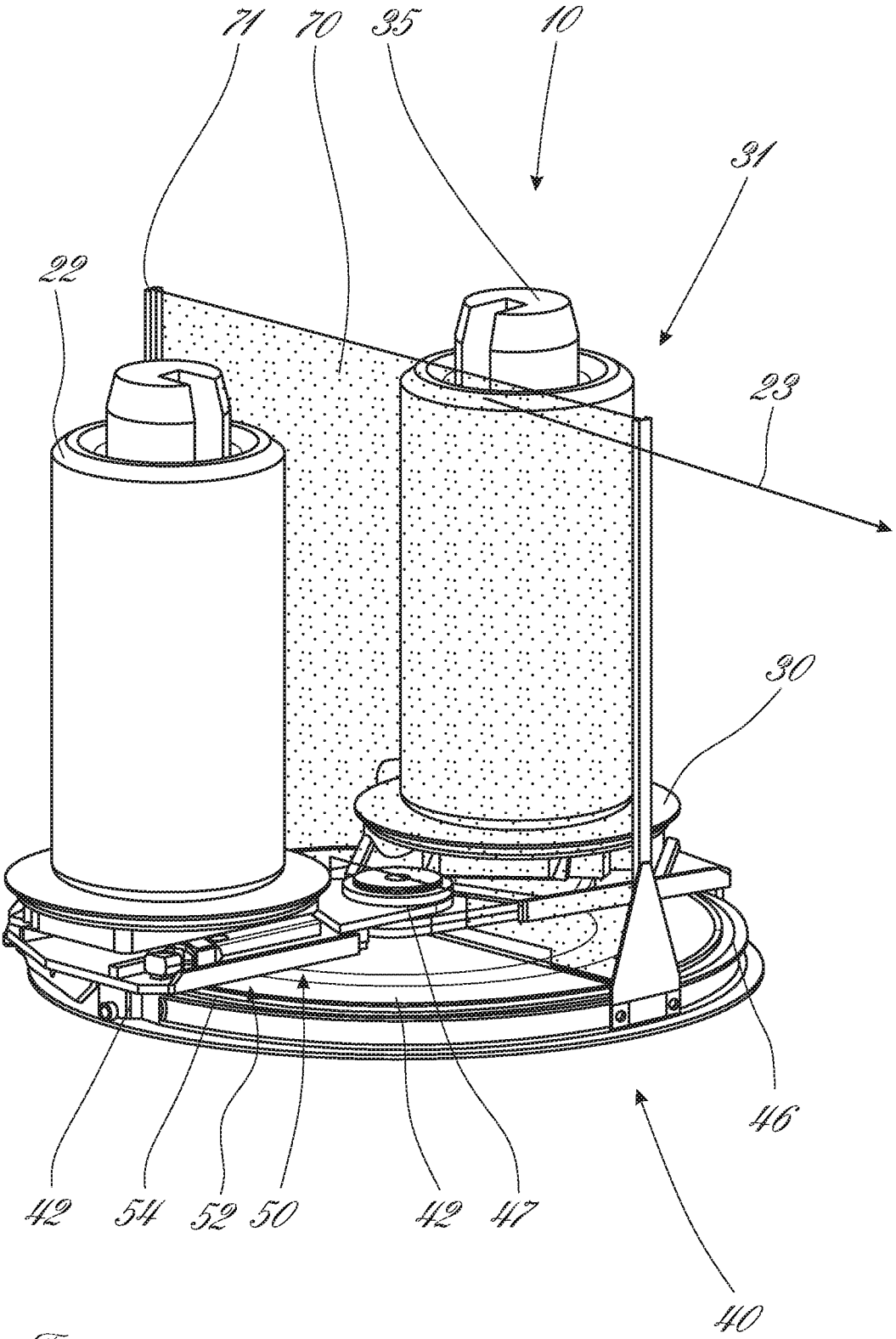
FIG. 4 a further unreeling apparatus in a perspective view, at a slant from above.

The embodiment according to FIG. 4 provides a round rotary body 42 as a displacement device 40, which simultaneously forms the safety apparatus 50.

The reel mandrels 35 are each disposed on mandrel crowns 30 and connected with an aboveground guide 46 that is situated radially on the outside on the rotary body 42. The reel mandrels 35 can be displaced radially around the aboveground mounting 47 by way of this aboveground guide 46.

It is also conceivable, if applicable while maintaining the other characteristics of the exemplary embodiments, if the reel mandrels are also connected with an belowground guide, which is situated radially on the outside of the rotary body 42, for example.

The drive for displacement of the reel mandrels 35 is configured as an aboveground drive 45. The overload safety device 52 of the safety apparatus 50 comprises a safety guide track 54, which is disposed radially on the outside of the rotary body 42. A deflection wall 70 is attached to the rotary body 42 by means of a deflection wall holder 71 and spatially separates the two reel mandrels 35 from one another.

Figure 5:
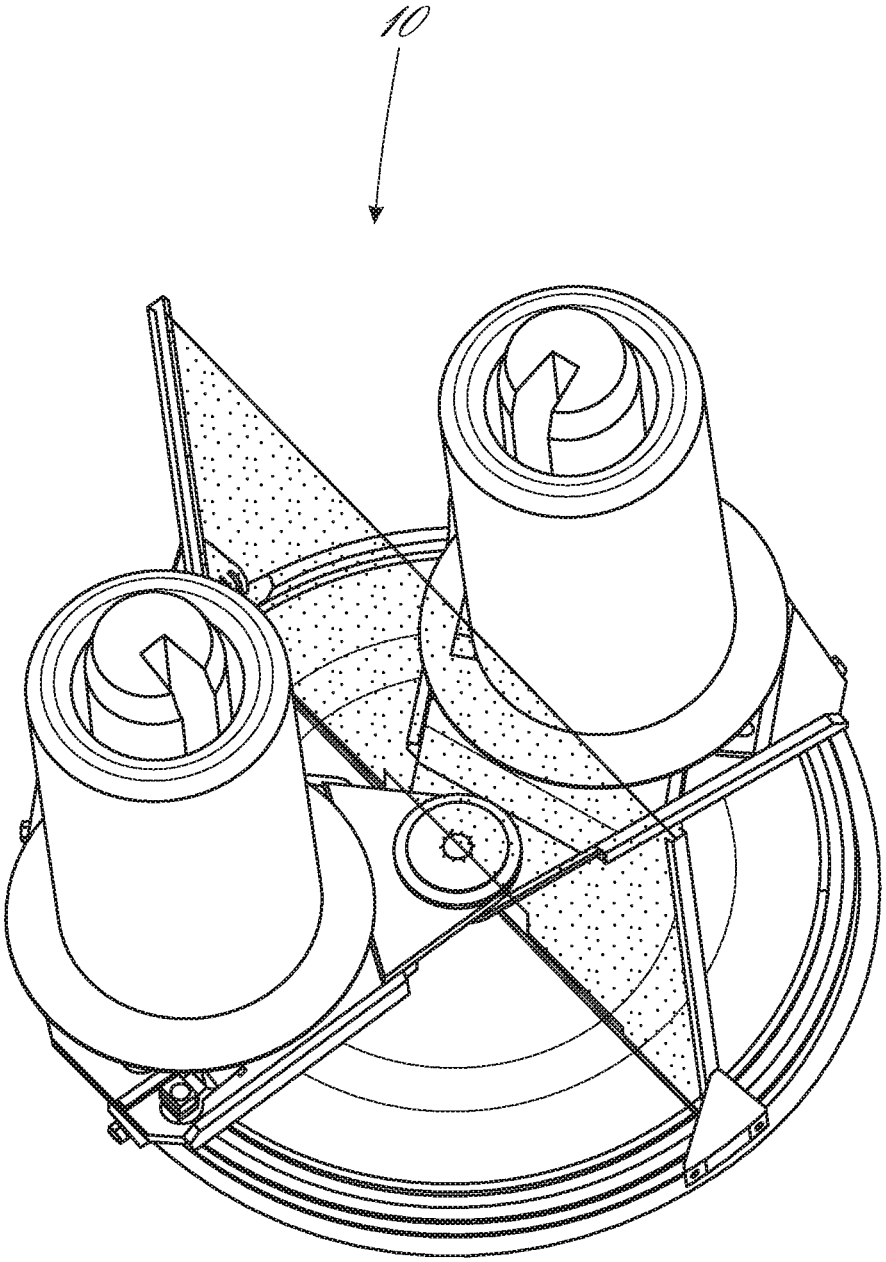
FIG. 5 the unreeling apparatus in a perspective view according to FIG. 4 from further above.
Figure 6:
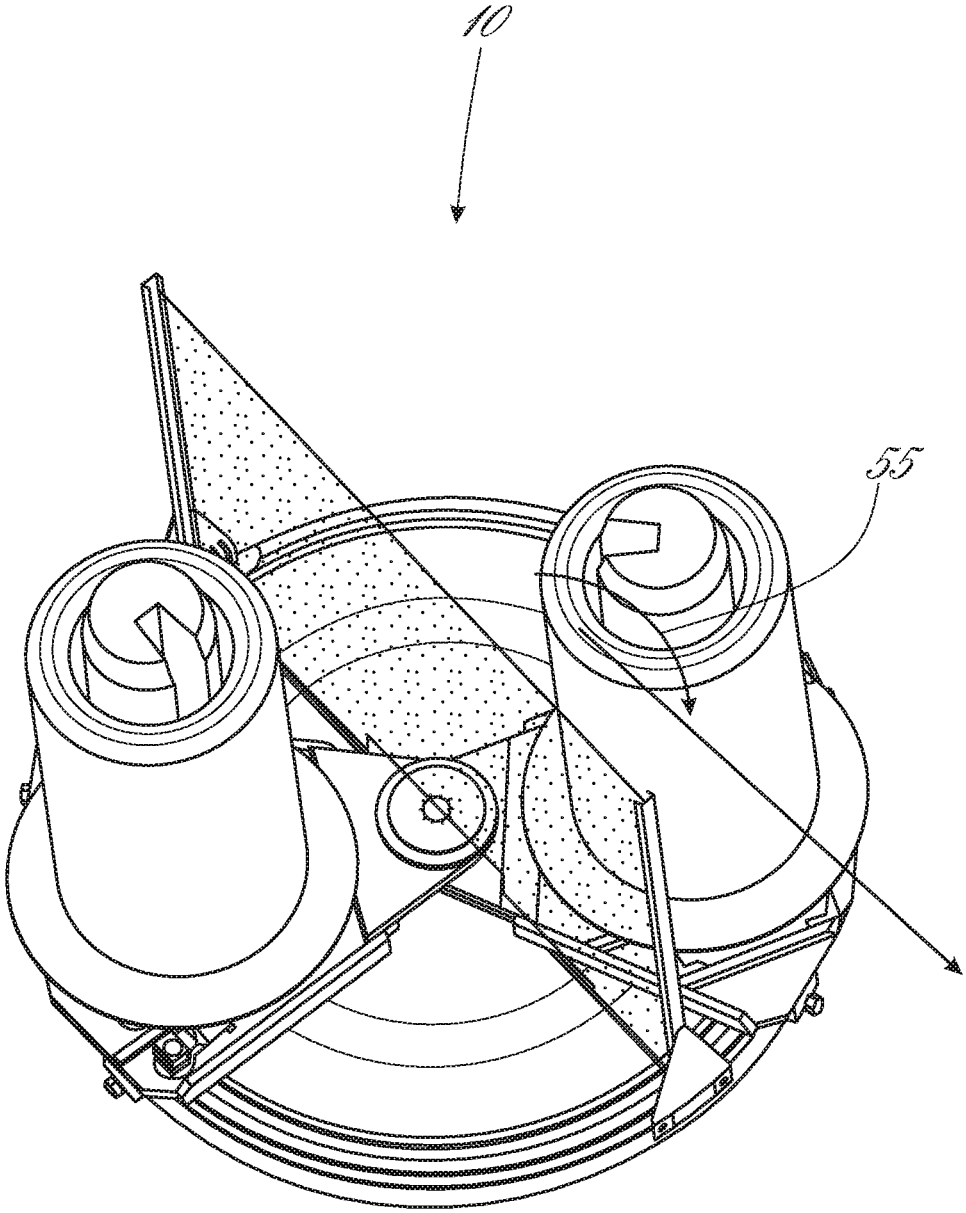
FIG. 6 the unreeling apparatus according to FIGS. 4 and 5 in a perspective view, at a slant from above, with a reel mandrel in the overloaded state.

FIGS. 5 and 6 show the unreeling apparatus according to FIG. 4, wherein in FIG. 5, the reel mandrel 35 is situated in the normal state, in the pull-off position 31, whereas the reel mandrel 35 is situated in the pull-off state 31 in the overloaded state. In the exemplary embodiment according to FIG. 6, an overload has occurred, and therefore the reel mandrel 35 has been displaced along the directional component 55 in the pull-off position 31.

In detail, the technical details that are being used in the exemplary embodiment shown in FIGS. 1 to 3 can also apply analogously in this exemplary embodiment.

Figure 7:
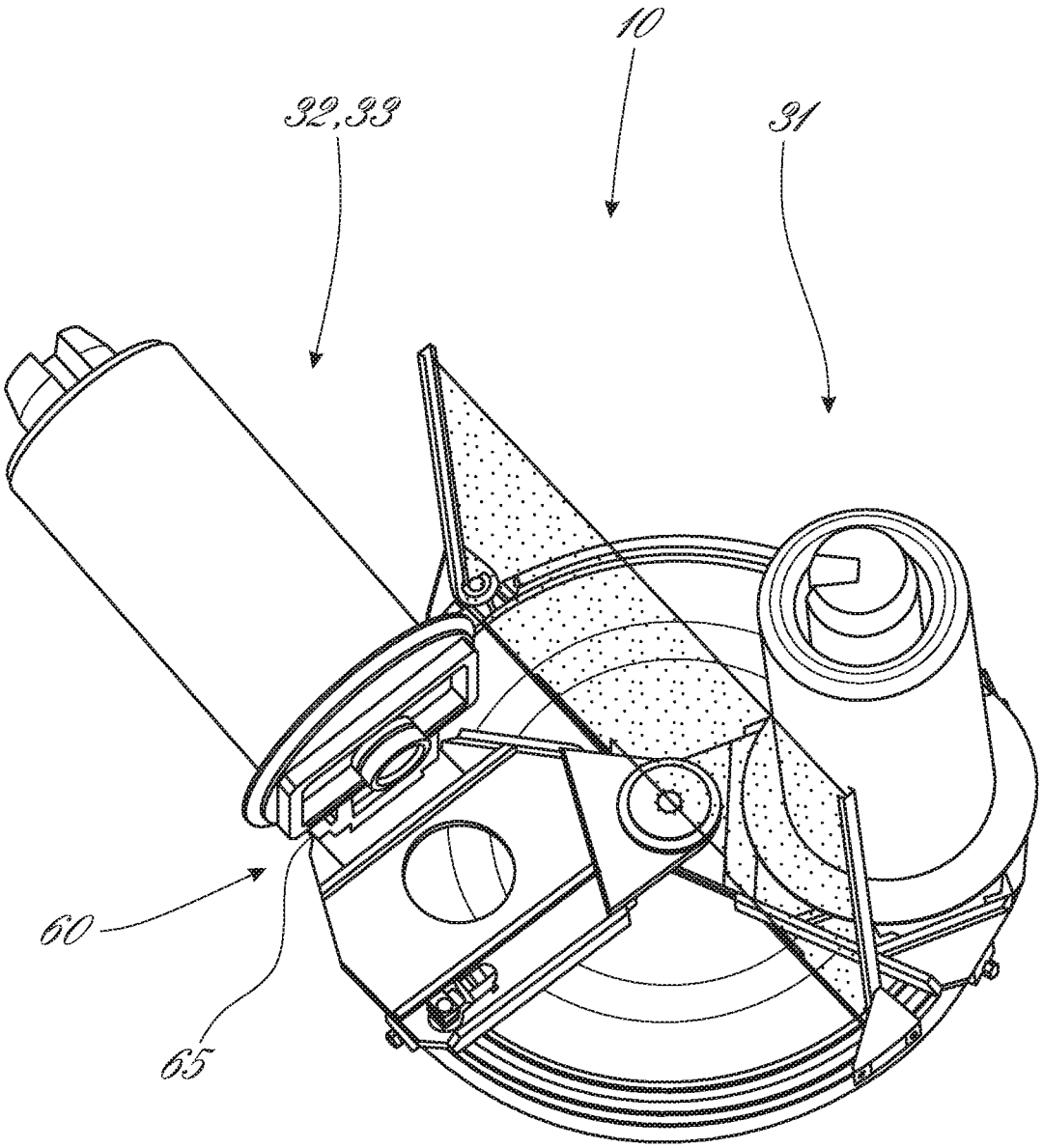
FIG. 7 the unreeling apparatus according to FIGS. 4 to 6 in a perspective view, at a slant from below, with a reel mandrel in the tilted state in the preparation position or loading position.

FIG. 7 shows an unreeling apparatus according to FIG. 6, wherein the reel mandrel 35 is situated in the preparation position or loading position 32, 33, and was tilted about a tilt joint 61 by means of the tilting device 60, and was made available for loading, for example. It is understood that loading can also be possible in the upright state of the reel mandrel 35.

In all the exemplary embodiments, a displacement device 40 allows the reel mandrel 35, which is upright again after loading and has been loaded, to be displaced to the preparation position 32 by way of a rotational movement about the aboveground mounting 47.

In the preparation position 32, numerous work steps can take place, which allow operationally safe procedures for the further method steps. For example, very thick wires 22 can be used. It is understood that wires having a great diameter are clearly more difficult to handle than thinner wires. Thus, provisioning of the wire 22 can take place in the preparation position 32, in that the wire is already unrolled from the reel mandrel 35 by a specific length, for example. In this way, the wire 22 can be introduced into the pulling machine significantly more easily or included in the subsequent processes.

Also possibly, depending on the thickness of the wire 22, the end of the wire cannot be introduced directly into the subsequent machines, for example a pulling machine, if the diameter of the wire 22 is too great. Thus, for example, measures to process the ends of the wires 22 can be undertaken in the preparation position 32. For example, at least a region of the wire 22 can be reduced in diameter. In order to make the end of the wire 22 graspable for subsequent machines, it is also conceivable to prepare the wire 22 by notching it, for example, in the preparation position 32, in such a manner that a corresponding grasping device can grasp the wire 22 in operationally safe manner and can pass it on to the subsequent machine, preferably a pulling machine.

The prepared and loaded reel mandrel 35 can subsequently be brought into the pull-off position 31 by means of the displacement device 40. In this pull-off position 31, pulling the wire 22 off in the pull-off direction 23 also takes place.

The pull-off position 31 comprises a safety apparatus 50, which consists of an overload safety device 52 and a press-down device 57. In the event of an overload, which can occur due to all the possible disruptive influences, such as a knot in the wire 22, for example, or the like, the reel mandrel 35 can still move along the safety guide track 54, so that in the event of a failure of the system or in the event of an overload, the reel mandrel 35 can still move along an established distance, so that the system comes to a stop in operationally safe manner.

An overload is frequently also accompanied by a rapid stop of the machine, so that no further wire 22 is unreeled along the pull-off direction 23.

However, the overload safety device 52 still gives the system some time so as to come to a stop in operationally safe manner, so that the reel mandrel 35 is not torn out of its foundation, for example, or out of the floor 12, thereby representing a hazard for the surroundings. In the normal pull-off state, the reel mandrel 35 is held in the pull-off position 31 by means of a hydraulic cylinder 59, for example, so that the forces introduced by pull-off do not already cause displacement of the reel mandrel 35 along the safety guide track 54.

REFERENCE SYMBOL LIST

10 unreeling apparatus
12 floor
14 horizontal
16 floor fitting
18 pull
20 ring
22 wire
23 pull-off direction
30 reel crown
31 pull-off position
32 preparation position
33 loading position
35 reel mandrel
38 reel crown holder
40 displacement device
42 rotary body
43 rotation axis
45 aboveground drive
46 aboveground guide
47 aboveground mounting
48 drive pinion
49 fixed gear wheel
50 safety apparatus
52 overload safety device
53 overload joint
54 safety guide track
55 directional component
56 safety guide axis
57 press-down device
58 pull-off position stop
59 hydraulic cylinder
60 tilting device
62 lever
63 arm
64 arm
65 tilt joint
66 tilt axis
70 deflection wall
71 deflector wall holder
81 pressure relief valve
82 safety sensor

The invention claimed is:

1. An unreeling apparatus for unreeling a ring of wire along a pull-off direction, having at least two reel crowns, which can each be brought into a pull-off position and into a preparation position and/or loading position by way of a displacement device, wherein each of the reel crowns comprises a safety apparatus having an overload safety device and a safety guide track, which track has a directional component that faces in the pull-off direction and acts independently of the other reel crown, at least for the reel crown situated in the pull-off position, wherein the overload safety device holds the reel crown situated in the pull-off position in the pull-off position and, in the event of an overload, releases the reel crown situated in the pull-off position into the safety guide track.

2. The unreeling apparatus according to claim 1, wherein the safety guide track has a safety guide axis.

3. The unreeling apparatus according to claim 2, wherein a rotary body has a rotation axis, and the safety guide axis is disposed not identically with the rotation axis.

4. The unreeling apparatus according to claim 2, wherein the rotary body has a rotation axis, and the safety guide axis corresponds to the rotation axis.

5. The unreeling apparatus according to claim 1, wherein the overload safety device comprises a press-down device that presses a reel crown holder against a pull-off position stop in the pull-off position.

6. The unreeling apparatus according to claim 5, wherein the press-down device is configured hydraulically or pneumatically, and has a pressure relief valve, which opens in the event of overload.

7. The unreeling apparatus according to claim 5, wherein the safety apparatus comprises a safety sensor, which detects if the reel crown holder leaves the pull-off position stop, and which is connected to act together with the pulling device that acts on the wire being unreeled, in such a manner that this device stops when the reel crown holder leaves the pull-off position stop.

8. The unreeling apparatus according to claim 1, wherein the displacement device has an aboveground drive and/or an aboveground guide or aboveground mounting.

9. The unreeling apparatus according to claim 8, wherein a rotary body is driven by way of the aboveground drive and/or guided by way of the aboveground guide and/or mounted by means of the aboveground mounting.

10. The unreeling apparatus according to claim 1, wherein the displacement device comprises a displaceable rotary body for holding at least one of the two reel crowns.

11. The unreeling apparatus according to claim 10, wherein the rotary body is displaceable solely in one plane.

12. The unreeling apparatus according to claim 10, wherein the two reel crowns are mounted on the rotary body.

13. The unreeling apparatus according to claim 1, wherein a rotary body is provided for each reel crown.

14. The unreeling apparatus according to claim 13, wherein the rotary bodies have an identical rotation axis.

15. The unreeling apparatus according to claim 1, wherein the displacement device comprises a displaceable rotary body that carries a tilting device for holding at least one of the two reel crowns, and wherein the reel crown can be tilted between the preparation position and the loading position.

16. The unreeling apparatus according to claim 15, wherein the tilting device comprises a lever, on a first arm of which the reel crown is disposed and on a second arm of which a tilt joint is disposed.

17. The unreeling apparatus according to claim 16, wherein the first arm on which the reel crown is disposed is connected with the second arm by way of an overload joint.

18. The unreeling apparatus according to claim 15, wherein the tilting device has a tilt axis that lies at the height of the reel crown.

19. The unreeling apparatus according to claim 1, wherein in the pull-off position, a deflection wall is provided, at least in the region of the pulled-off wire and/or at least in the region of the reel crown situated in the pull-off position or a reel mandrel relative to the reel crown not situated in the pull-off position.

20. The unreeling apparatus according to claim 19, wherein the deflection wall is disposed on a rotary body.

* * * * *